United States Patent [19]

Rudnick et al.

[11] 4,332,055

[45] Jun. 1, 1982

[54] HINGE WITH A SPRING ARM CATCH

[76] Inventors: Jack Z. Rudnick, 242 E. 19th St., New York, N.Y. 10003; Edward B. Okonski, 61-53 75th Rd., Middle Village, N.Y. 11379; John J. Rottenkolber, 3522 Sagamore Trail, Mohegan Lake, N.Y. 10547

[21] Appl. No.: 143,501

[22] Filed: Apr. 24, 1980

[51] Int. Cl.[3] ..... E05D 11/08

[52] U.S. Cl. ..... 16/335; 16/392

[58] Field of Search ..... 16/135, 142, 145, 335, 16/341, 392

[56] References Cited

U.S. PATENT DOCUMENTS

| | | | |
|---|---|---|---|
| 769,035 | 8/1904 | Walter | 16/330 |
| 956,738 | 5/1910 | Schwarz | 16/334 |
| 1,440,713 | 1/1923 | Ausbourne | 16/324 |
| 1,564,611 | 12/1925 | Mountford | 16/322 |
| 1,589,613 | 6/1926 | Mountford | 16/334 |
| 2,678,463 | 5/1954 | Westphal | 16/135 |
| 2,762,028 | 9/1956 | DeConingh et al. | 339/255 P |
| 2,774,098 | 12/1956 | Tieri | 16/228 |
| 3,212,126 | 10/1965 | Ruiz | 16/297 |
| 3,237,239 | 3/1966 | Rudnick | 16/335 |
| 3,401,422 | 9/1968 | Ventura | 16/54 |
| 3,608,130 | 9/1971 | Rudnick | 16/335 |

FOREIGN PATENT DOCUMENTS

| | | | |
|---|---|---|---|
| 1271594 | 6/1968 | Fed. Rep. of Germany | 16/135 |

*Primary Examiner*—Henry Jaudon
*Assistant Examiner*—Andrew M. Falik
*Attorney, Agent, or Firm*—Vogt & O'Donnell

[57] ABSTRACT

A hinge including a pair of pivotally connected elements. One element of the hinge has an undulate cam surface extending about the pivot axis of the hinge and the other element has a base surface and a groove in the base surface. A spring having a straight leg and an arm extending from one end of the leg may be engaged in the groove so that the free end of the arm bears on the cam surface to provide detent and drag functions for controlling relative pivoting motion of the hinge elements. When the hinge elements are attached to structures such as panels of a folding door assembly, the structure associated with the grooved element helps to retain the leg of the spring in the groove. The hinge elements may be provided with tabs which abut one another, providing a stop to limit relative motion of the hinge elements.

15 Claims, 8 Drawing Figures

HINGE WITH A SPRING ARM CATCH

BACKGROUND OF THE INVENTION

This application relates to the art of hinges, and more particularly related to a hinge which has a detent mechanism.

The hinge of the present invention is especially suited for use in a bi-fold or "accordian" door assembly. An accordian door assembly consists of one or more pairs of rectangular panels which are arranged to lie in a common plane when the door is closed. The adjacent or inner edges of the panels of each pair are hingedly connected to one another. The outer edge of each panel, remote from the hinged connection, is pivotally mounted to a track. At least one such outer edge of each pair of panels is also slidable with respect to the track.

Thus, the door may be opened by sliding the outer edges of each pair of panels toward one another, and folding the pair of panels against one another at their hinged connection. It is generally desirable to yieldably retain or "detent" the panels alternatively in the fully-opened or fully-closed positions. It is also desirable to provide a moderate frictional drag to resist movement of the panels over a range of positions between the fully-opened and fully-closed positions.

Hinges for use in accordian-type door assemblies must provide a multiplicity of features and must meet several stringent requirements.

Although the detent and frictional drag functions can be performed by structures other than the hinges, it is desirable to incorporate these functions in the hinges to minimize the cost and complexity of the assembly. However, in some cases, it will prove desirable to eliminate or disable the detent and drag mechanisms in one or more of the hinges in a particular assembly during installation. For example, if the panels of a particular assembly are especially long, and a large number of hinges will be used at each hinged connection between panels, then it may be desirable to eliminate the detent and drag functions from some of the hinges at each such connection to moderate the detent and drag forces in the assembly. Therefore, if the detent and frictional drag functions are incorporated in the hinge structure, the hinge should be designed so that these functions can be readily disabled or eliminated during installation.

A hinge for use in accordian-type door assemblies should also provide a positive stop to assure that, when the panels which the hinge connects are in the fully-closed position, they are precisely coplanar with one another. Preferably, the stop should be preset during manufacture of the hinge, so that its accuracy does not depend upon careful installation in the field.

Normally, at least two hinges will be used to connect each pair of panels in an accordian-type door assembly. To prevent binding and jamming of the panels, it is essential to accurately align all of the hinges which connect the same pair of panels so that the pivot axes of all of such hinges are coaxial with one another. Hinges for use in accordian-type door assemblies should, therefore, be constructed and arranged to minimize the care and skill required in installation to achieve such alignment.

The hinges in an accordian-type door assembly may be subjected to substantial forces due to the weight of the door panels and may also be subjected to additional substantial and unpredictable forces if the door assembly is abused. Therefore, hinges for use in such an assembly should be strong enough to resist such forces without damage. Further, such hinges should be constructed so that they may be mounted to the door panels in such a manner as to provide a strong connection between the hinges and the panels, even if the panels are formed from a relatively weak material such as particle board.

The hinges in a door assembly should last for the life of the door assembly and they should not require any maintenance during their lifetime. When the door assembly is painted, the hinges may be covered with a thick coating of paint. The hinges should continue to operate properly, and should continue to provide the aforementioned detent and drag functions, even after they have been covered with many coats of paint.

Because each accordian-type door assembly will normally include a substantial number of hinges, and a large number of door assemblies may be installed in a single building, the price of the hinges is of substantial importance. Therefore, hinges for this application must be manufacturable by the simplest possible methods from readily available materials.

Various hinge structures have been used in an accordian-type door assemblies. Most notably, the hinge structures set forth in U.S. Pat. Nos. 3,237,239 and 3,608,310, issued Mar. 1, 1966 and Sept. 28, 1971, respectively, to Jack Rudnick, have been widely adopted for this purpose. However, prior to the present invention, there has still been a need for a hinge which would better fulfill the aforementioned requirements.

SUMMARY OF THE INVENTION

It is an object of the present invention to provide a hinge which will satisfy the aforementioned requirements to a greater degree than the hinges of the prior art, and which, in its preferred embodiment, will simultaneously satisfy all such requirements.

It is a further object of the present invention to provide such a hinge through the use of only a minimal number of parts, without making any of the parts inordinately complex or difficult to manufacture.

A hinge according to one aspect of the present invention includes a first element, a second element and means for pivotally connecting these elements to one another at a pivot axis which is common to both of them. The first element has an undulate cam surface which extends about the pivot axis. This cam surface defines at least one projecting portion or "peak." Each such peak has sloping ramp surfaces extending to its summit. The second element has a generally planar base surface and an elongated groove which is open to the base surface. The hinge also includes a spring which has a generally straight leg and an arm which extends from a first end of the leg. The free end of the arm, remote from the juncture of the arm and the leg, is remote from the axis of the leg and is engaged with the cam surface of the first element. The leg of the spring is releasably received in the groove of the second element so that the spring is affixed to the second element while the leg is in the groove.

The spring is constructed and arranged to bias the arm pivotally about the axis of the leg and urge the free end of the arm towards the cam surface. Because the spring is affixed to the second element, pivoting motion of the elements during service will cause the free end of the arm to sweep across the cam surface of the first element. When the elements are in a relative pivotal position wherein the free end of the arm is aligned with a sloping ramp surface of one of the peaks, the free end of the arm will engage such surface and will yieldably retain the elements in such pivotal position. The elements are constructed and arranged so that they may be attached to the structures which the hinge is to connect in service in such a manner that the base surface of the second element will overlie a surface of the associated structure. This surface will retain the leg of the spring in the groove of the second element while the hinge is in service.

Thus, when the hinge of the present invention is used to pivotally connect two adjacent panels of an accordian-type door assembly, a surface of one such panel will serve to retain the leg of the spring in the groove. Therefore, no special spring-retaining elements need be incorporated in the hinge of the present invention although such elements could be used if desired. Of course, if it is desired to eliminate the detent feature from a hinge of the present invention when that hinge is installed, the spring can be removed from the hinge prior to installation. Conversely, the hinge of the present invention can be assembled without the spring by the manufacturer, and the spring can be provided separately. When the detent action is desired, it is a simple matter for the installer to slip the spring into position and seat the leg of the spring in the groove before fastening the hinge to the door panels.

Because the free end of the arm sweeps across the cam surface during the pivoting motion of the hinge elements, it will rapidly scrape away any paint which may accidentally be deposited on the cam surface. Because the arm pivots about the axis of the leg, the arm acts as a lever; the free end of the arm can move through a substantial distance while the leg twists or rotates about its axis through only a small angle. Thus, the amplitude of the undultions on the cam surface can be substantial, and variations in this dimension or in the dimensions of the spring caused by imperfections in the manufacturing process will not materially affect the performance of the hinge.

A hinge according to another aspect of the present invention includes a pair of elements and means for pivotally connecting the elements. Each element includes a base wall and at least one tab which extends downwardly from the forward edge of its base wall. Each tab of the first element is aligned with an opposing tab of the second element, so that opposing tabs will abut one another when the elements of the hinge are in a flat position in which their base walls are substantially coplanar. Thus, when the elements of the hinge are fastened to adjacent panels of an accordian-type door, the abutting tabs will provide a reliable stop to assure that the panels are exactly coplanar when the door is closed.

Preferably, at least one tab of each element is an attachment tab which has a hole formed in it, and the base wall of each element has at least one hole formed in it. Thus, each element of the hinge can be fastened to the associated door panel by screws which extend through the tab and through the base wall of the element. Because the screws which affix each element to the associated panel extend generally perpendicularly to one another, at least one such screw will be loaded in shear by any load which is applied to the hinge. Thus, the hinge will be securely anchored to the door panel.

These and other objects, features and advantages of the present invention will be more readily apparent from the following detailed description of the preferred embodiments, when read in conjunction with the accompanying drawings.

DETAILED DESCRIPTION OF THE PREFERRED EMBODIMENTS

Figure 1:
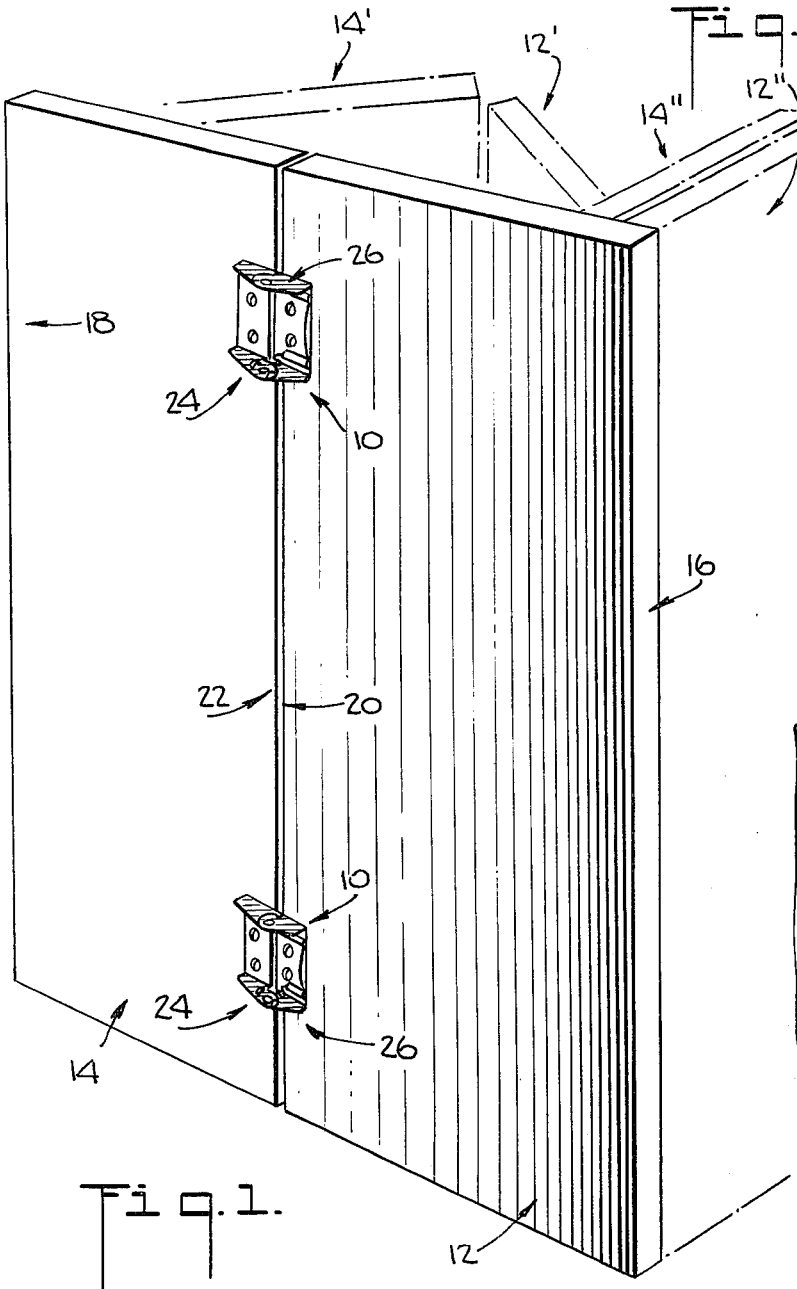
FIG. 1 is a perspective view depicting a two panels of an accordian-type door assembly together with two hinges according to the preferred embodiment of the present invention.

As shown in FIG. 1, a pair of hinges 10 according to the preferred embodiment of the present invention may be incorporated in an accordian-type door assembly. The door assembly shown in FIG. 1 includes a pair of panels 12 and 14. The outer edge 16 of one panel 12 is pivotally mounted to the surrounding building structure (not shown). The outer edge 18 of the other panel 14 is pivotally and slidably mounted to the surrounding building structure by means of a track (not shown). The inner edges 20 and 22 of the panels are hingedly connected by the hinges 10. In the closed position of the assembly, the panels 12 and 14 are substantially coplanar. As the door opens, the inner edges 20 and 22 move forwardly (upwardly and to the right in FIG. 1), the outer edge 18 of panel 14 slides inwardly along the track towards the outer edge 16 of panel 12, and each of the panels pivots about its outer edge. Thus, the panels pass through the partially-open position depicted in broken lines at 12' and 14' to the fully-open position depicted at 12'' and 14''.

Figure 6:
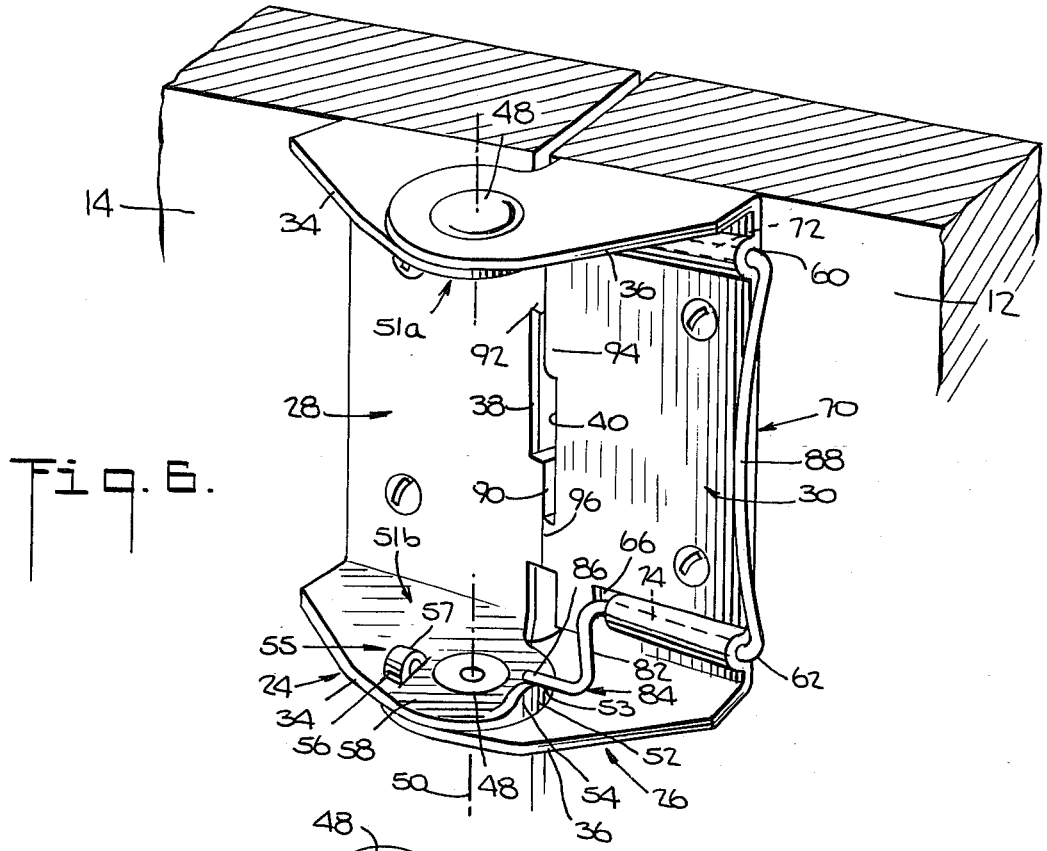
FIG. 6 is a perspective view of the hinge shown in FIGS. 1 through 5.
Figure 7:
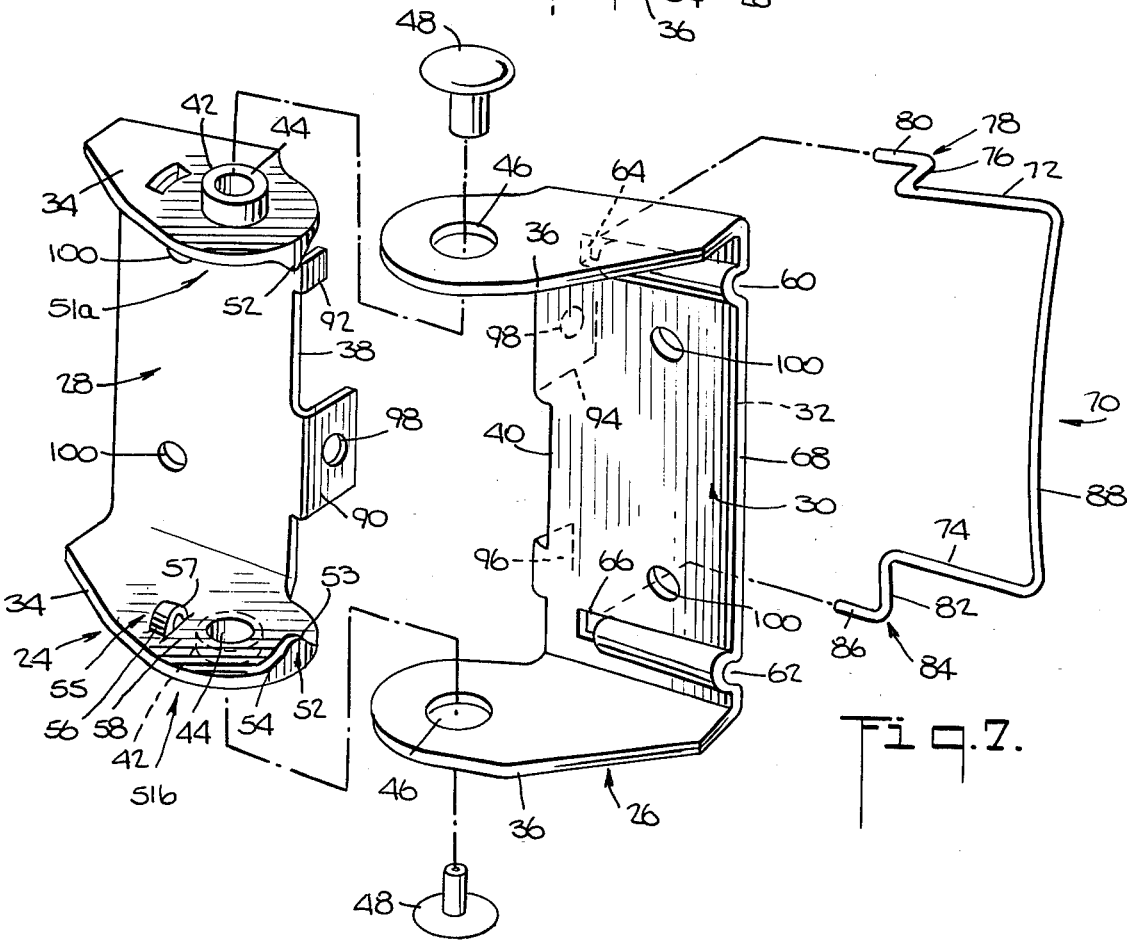
FIG. 7 is an exploded view of the hinge shown in FIGS. 1 through 6.

As best seen in FIGS. 6 and 7, the hinge of the present invention includes a first element 24 and a second element 26. The first element has a generally flat base wall 28, and the second element has a generally flat base wall 30. The base wall 30 of the second element 26 defines a generally planar base surface 32 on its underside (the side hidden from view in FIG. 7).

The first element 24 has a pair of end walls 34 which extend upwardly from its base wall 28 at opposite ends of the base wall. The second element 26 has a similar pair of end walls 36 which extend upwardly from its base wall 30 at opposite ends of that base wall. The end walls 36 of the second element are spaced slightly further apart from one another than are the end walls 34 of the first element. The end walls 34 of the first element protrude forwardly beyond the forward edge 38 of the base wall of that element. Likewise, the end walls 36 of the second element protrude forwardly beyond the forward edge 40 of the base wall of that element. Thus, as shown in FIG. 6, at each end of the hinge the forwardly projecting portion of an end wall 34 of the first element overlaps the forwardly-projecting portion of an end wall 36 of the second element.

As best seen in FIG. 7, a generally cylindrical boss 42 extends outwardly from the forwardly-projecting portion of each end wall 34 of the first element. These bosses are substantially coaxial with one another. A bore 44 extends generally coaxially through each such boss and through the associated end wall. Each one of the end walls 36 of the second element has a hole 46 in its forwardly-projection portion. These holes are substantially coaxial with one another and the inside diameters of these holes are slightly larger than the outside diameters of the bosses. Each one of the bosses 42 protrudes through one of the holes 46, and is retained in engagement with such hole by an associated rivet 48 which extends through the bore 44 in the boss. Because each one of the bosses 42 on the first element protrudes beyond the outer surface of the associated end wall 36 of the second element, the heads of the rivets 48 do not bear on the end walls 36 of the second element.

As will be apparent, the elements 24 and 26 are pivotally connected to one another by this arrangement of bosses and holes. They may pivot, relative to one another, about the common axis 50 of the bosses and holes (FIGS. 2 through 6). The term "pivot axis" will be used in this disclosure to describe the common axis about which the elements of a hinge may pivot relative to one another. Also, the term "axially," as used in this disclosure to describe the position or orientation of portions of a hinge structure, should be understood to mean "in a direction parallel to the pivot axis of the hinge."

As shown in FIGS. 2 through 7, each one of the end walls 34 of the first element 24 defines an undulate cam surface 51 extending about the pivot axis 50 on the inner side of such end wall. Each such cam surface includes a generally axially-projecting "hold-closed" peak 52 having a first sloping side 53 (FIG. 7), and a second sloping side 54 extending to its summit. Each cam surface 51 also includes a generally axially projecting "hold-open" peak 55 having a first sloping side 56 and a second sloping side 57 extending to its summit, and a flat "valley bottom" surface 58 which extends from the second sloping side 53 of its hold closed peak to the first sloping side 56 of its hold open peak. The peaks of each cam surface are arranged about the pivot axis 50 so that the hold-closed peak 52 of each cam surface is aligned with the hold-closed peak of the opposite cam surface, and the hold-open peak 55 of each cam surface is aligned with the hold-open peak of the opposite cam surface.

The base wall 30 of the second element 26 is convoluted at two places to provide a first elongated groove 60 and a second elongated groove 62 which are open to the base surface 32 of the first element. A hole 64 extends through the base wall 30 at the forward end of the first groove 60, and a similar hole 66 extends through the base wall 30 at the forward end of the second groove 62. Each one of the grooves extends generally rearwardly from the associated hole to the rear edge 68 of the base wall 30.

Figure 4:
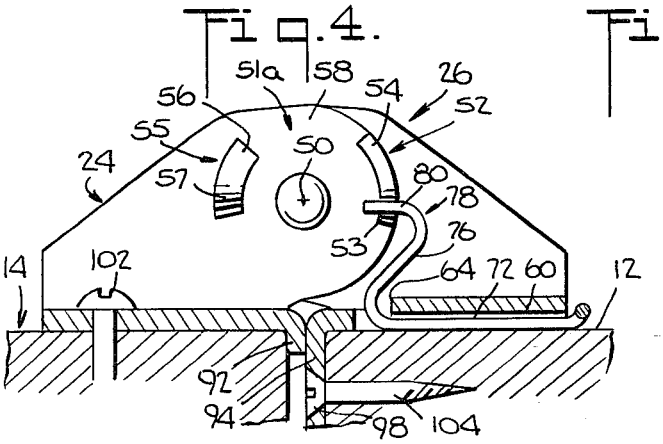
FIG. 4 is a sectional view taken along line 4—4 in FIG. 2.
Figure 5:
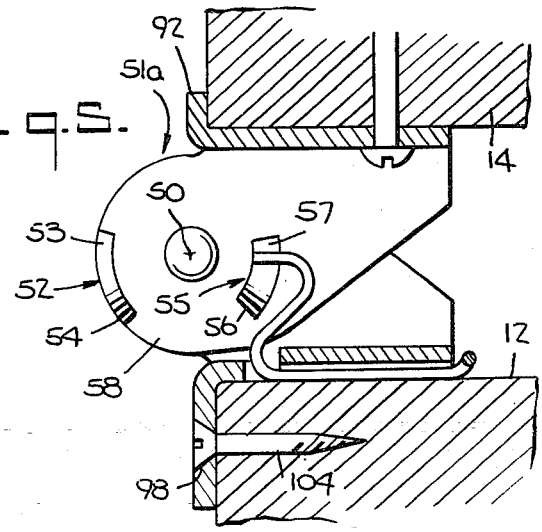
FIG. 5 is a sectional view, similar to FIG. 4, but depicting the hinge shown in FIGS. 1 through 4 in a different operating position.

A bent wire spring 70 is associated with the second element 26. The spring 70 includes a first leg 72 and a second leg 74. These legs are generally straight, substantially parallel with one another and substantially coplanar. As best seen in FIG. 4, a first arm 76 extends generally upwardly and rearwardly from the first or forwardmost end of the first leg 72. The free end 78 of the arm 76 is remote from the axis of the first leg 72. The free end 78 of the first arm 76 includes an engagement tab 80 which extends generally forwardly from the remainder of the arm 76, so that the engagement tab 80, the remainder of the arm 76 and the first leg 72 define a generally Z-shaped unit. A second arm 82 (FIG. 7) extends generally upwardly and rearwardly from the first or forwardmost end of the second leg 74. The second arm 82 is substantially identical to the first arm 76. That is, the free end 84 of the second arm is remote from the axis of the second leg. The free end 84 of the second arm includes an engagement tab 86 which extends forwardly from the remainder of the second arm.

Figure 3:
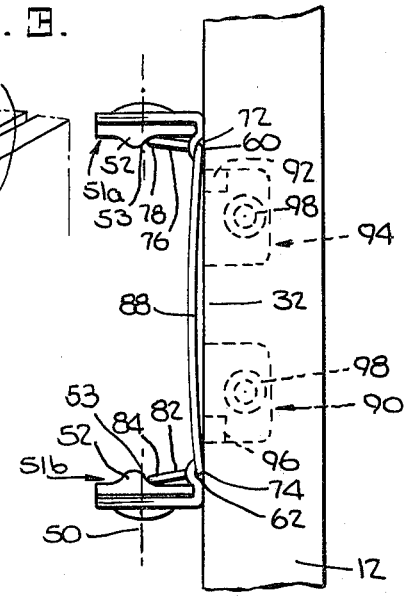
FIG. 3 is an elevational view taken along line 3—3 in FIG. 2.

The spring 70 also includes a beam member 88 which extends from the second or rearwardmost end of the first leg 72 to the second or rearwardmost end of the second leg 74. As best seen in FIG. 3, the beam member 88 is not straight; rather, it is bowed upwardly, so that the central portion of the beam member extends above the plane of the legs.

As shown in FIGS. 3, 4, 6 and 7, the first leg 72 of the spring is releasably received in the first groove 60, and the second leg 74 of the spring is releasably received in the second groove 62. The first arm 76 extends through the hole 64 (FIG. 4) at the forwardmost end of the first groove so that the free end 78 of the first arm is engaged with a first one 51*a* of the cam surfaces on the end walls of the first element, with the engagement tab 80 bearing on such cam surface. The second arm 82 extends through the hole 66 (FIG. 6) at the forwardmost end of the second groove so that the free end 84 of the second arm is engaged with a second one 51*b* of the cam surfaces on the end walls of the first element.

In the undeformed state of the spring, the free ends 78 and 84 (FIG. 3) are spaced further apart from one another than the cam surfaces 51*a* and 51*b*. When the hinge is initially assembled, the free ends of the arms are squeezed towards one another so that the arms of the spring pivot inwardly towards one another about the axes of the associated legs. This motion is transmitted through the legs of the spring, so that the beam member 88 of the spring is stressed in bending during assembly of the hinge. Thus, in the assembled hinge, the stressed beam member tends to twist the legs 72 and 74 in opposite directions, so as to bias the free ends 78 and 84 of the arms outwardly against the cam surfaces 51*a* and 51*b*. Thus, each one of the free ends will be forced against the associated cam surface by the spring. As will be described below, the spring and cam surfaces will provide a detent action and a frictional drag to control the pivoting motion of the elements 24 and 26 while the hinge is in service.

Figure 2:
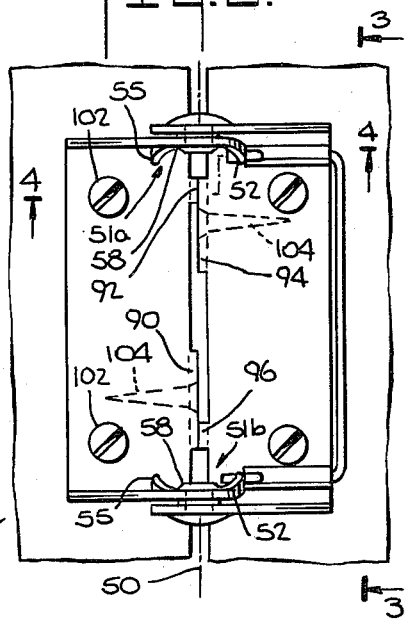
FIG. 2 is a plan view depicting a hinge according to the preferred embodiment of the present invention.

As shown in FIG. 7, the first element 24 is provided with an attachment tab 90 and an alignment tab 92 which extend downwardly from the base wall 28 of the element at its forward edge 38. Likewise, the second element 26 is provided with an attachment tab 94 and an alignment tab 96, which extend downwardly from the base wall 30 of the second element at its forward edge 40. The attachment tabs 90 and 94 are larger than the alignment tabs 92 and 96. A countersunk hole 98 is formed in each one of the attachment tabs. As shown in FIGS. 2, 3 and 6, the alignment tab of each element is axially aligned with a portion of the attachment tab of the opposing element, but the alignment tab of each element is arranged so that it is not aligned with the countersunk holes 98 in the attachment tab of the opposing element. For example, the alignment tab 92 of the first element is axially aligned with a corner of the attachment tab 94 of the second element. Two screw holes 100 extend through the base wall of each element.

The hinge described above is intended to connect a pair of panels in an accordion-type door assembly of the type described above with reference to FIG. 1. As depicted in FIGS. 2, 4 and 6, the first element 24 of the hinge is affixed to one panel 14, and the second element 26 of the hinge is affixed to the opposing panel 12. A pair of screws 102 extend through the holes in the base wall of each element to hold each such base wall against the surface of the associated panel. A flathead screw 104 extends through the hole in the attachment tab of each element and holds each such attachment tab firmly against the edge of the associated panel. Thus, each one of the elements 24 and 26 is affixed to the associated panel by screws which extend into the panel from its face and from its edge. Therefore, any loads tending to pull either of the hinge elements loose from the associated panel will be resisted by at least one screw in shear. This arrangement is particularly useful in providing a secure anchorage of the hinge elements to the door panels when the panels are made from a relatively weak material such as particle board. Typical wood screws threadely engaged in such materials provide only limited pullout resistance, but provide a strong resistance to shearing loads.

Because the alignment tab and the engagement tab of each hinge element abut the edge surface of the associated door panel, and the base wall of each hinge element abuts the face of the associated panel, each hinge element will be precisely located with respect to the associated panel. Thus, the pivot axis of the hinge will be precisely located with respect to the associated panel, and the pivot axis will extend parallel to the edge of the panel. If a plurality of hinges are used to connect a single pair of panels, the pivot axes of all of such hinges will be precisely coaxial with one another provided that the edges of the panels are straight. The precision of such alignment will not depend upon the skill of the workman who installs the hinges on the panels.

As stated above, the base wall of each element of the hinge is firmly secured against the face of the associated panel. Therefore, the base surface 32 of the second element (the underside of the base wall 30 of the second element) will closely overlie the face of the associated panel 12. The face of the panel 12 will thus retain the legs 72 and 74 of the spring in the grooves 60 and 62 while the hinge is in service.

Because the base walls 28 and 30 of the hinge elements closely overlie the faces of the respectively associated panels 14 and 12 of the door assembly, these panels will be precisely coplanar with one another when the hinge is in the fully-flat position depicted in FIGS. 2,3,4 and 6. In that position, the base walls of the elements are coplanar, and the forward edges 38 and 40 of the base walls confront one another. The alignment tab 92 of the first element abuts the attachment tab 94 of the second element, and the alignment tab 96 of the second element abuts the attachment tab 90 of the first element. Thus, the hinge elements cannot pivot beyond the fully-flat position.

When the hinge is in the fully-flat position, the free end 78 of the first arm of the spring is engaged with the first sloping surface 53 (FIG. 4) of the hold-closed peak 52 of the first cam surface 51*a*. Likewise, the free end 84 of the second arm is engaged with the first sloping surface 53 of the hold-open peak 52 of the second cam surface 51*b* (FIGS. 3 and 6). As set forth above, the free ends 78 and 84 of the spring arms are biased outwardly, away from one another and towards the cam surfaces. Thus, the engagement of the free ends of the spring arms with the sloping surfaces 53 of the hold-closed peaks 52 will tend to bias the hinge elements toward the fully-flat position. That is, such engagement will tend to pivot the first element 24 counterclockwise about the pivot axis 50 relative to the second element 26 as seen in FIG. 4. However, the abutting tabs 92 and 94, visible in FIG. 4, and the other abutting tabs 90 and 92 shown in FIGS. 2, 3 and 6, will prevent any such motion. Thus, the hinge elements will be retained in the fully-flat position, and the door panels 12 and 14 will be held precisely coplanar with one another while the door is closed.

As will be appreciated with reference to FIGS. 2 and 3, the precise coplanar alignment of the door panels in the closed position will not be impaired even if the flathead screws 104 are improperly installed so that their heads are not fully seated in the countersunk holes in the attachment tabs 90 and 94. Because the alignment tabs 92 and 96 are remote from the countersunk holes 98 in the attachment tabs, any screw head which protrudes from one of these holes will simply bypass the opposing alignment tab.

As described above with reference to FIG. 1, the door panels 12 and 14 pivot relative to one another during the opening motion of the door. Thus, to move the door from the closed position, the first element 24 must pivot clockwise, as seen in FIG. 4, relative to the second element 26 about the pivot axis 50. Because the spring is retained in fixed position relative to the second element 26, such pivoting motion will cause the engagement tab 80 (FIG. 4) of the free end 78 of the first spring arm to sweep across the cam surface 51*a* on the first element. Likewise, the engagement tab 86 (FIG. 6) of the free end 84 of the second spring arm will sweep across cam surface 51*b* of the first element. During the initial portion of such movement, the free ends 78 and 84 are forced axially inwardly, toward one another by the first sloping surfaces 53 of the hold-closed peaks 52. To allow such inward motion of the free ends 78 and 84, the legs 72 and 74 of the spring pivot about their respective axes. As seen in FIG. 3, the first leg 72 pivots counterclockwise, and the second leg 74 pivots clockwise. Because the beam member 88 of the spring is unsupported except at its attachments to the legs 72 and 74, the beam member 88 can bend downwardly at its center towards the surface of the door panel 12 in response to the pivoting of the legs 72 and 74, thus substantially straightening the bow in the beam member 88. Although some of the inward motion of the free ends 78 and 84 is accommodated by bending of the arms 76 and 82, and by twisting of the legs 72 and 74, the greater portion of such motion is accommodated by the bending of the beam member 88.

As the opening motion of the door assembly and the relative pivoting motion of the hinge elements, continue, the free ends 78 and 84 of the spring arms bypass the hold-closed peaks 52 of the cam surfaces 51. The resilience of the spring causes the free ends 78 and 84 to move axially outwardly, away from one another. Each one of the free ends 78 and 84 enters into the valley on the associated cam surface 51 so that its engagement tab 80 bears upon the associated valley bottom surface 58.

While the free ends of the spring arms are engaged with the valley bottom surfaces 58, friction between the valley bottom surfaces and the engagement tabs of the free ends will inhibit relative pivotal motion of the hinge elements, and will thus inhibit any opening or closing motion of the door assembly. Because the valley bottom surfaces 58 have a substantial circumferential extent about the pivot axis 50, such frictional drag will be maintained over a substantial range of relative pivotal positions of the hinge elements. This range of pivotal positions corresponds to a substantial range of partially-open positions of the door assembly, including the partially-open position depicted in broken lines at 12' and 14' in FIG. 1.

Continued opening motion of the door assembly will cause the first element 24 to continue to pivot counterclockwise, as seen in FIG. 4, about the pivot axis 50, relative to the second element 26. As the door panels approach the fully-open position depicted in broken lines at 12'' and 14'' in FIG. 1, and the hinge elements approach the position depicted in FIG. 5, the free ends of the spring arms will encounter the hold-open peaks 55 of the cam surfaces 51. The free ends of the spring arms will be forced inwardly, towards one another, as they encounter the first sloping surfaces 56 of the hold-open peaks 55. As the door panels reach the fully-open position, the free ends of the spring arms will go past the summits of the hold-open peaks 55, and will move outwardly along the second sloping surfaces 57 of these peaks. When the door panels are in the fully-open position, and the hinge elements are in the position depicted in FIG. 5, each one of the free ends of the spring arms is engaged with the second sloping surface 57 of the associated hold-open peak 55. Thus, the spring and the cam surfaces will yieldably retain the hinge elements in the position depicted in FIG. 5, and will thus yieldably retain the door panels in the fully-open position.

When the door panels are moved from the fully-open position to the fully-closed position, the sequence of operation described above is reversed. Of course, the opening or closing motion of the door panels may be stopped at a position between the fully-open and fully-closed positions, whereupon the friction drag feature of the hinge will maintain the panels in such position until they are deliberately moved again.

The wiping action of the engagement tabs of the spring arms on the cam surfaces provides two important advantages. First, if the cam surfaces are inadvertently painted over, the wiping action will rapidly scrape off the paint. Second, the wiping action of the engagement tabs will rapidly polish off any burrs or other irregularities which may be formed on the cam surfaces during manufacture of the hinge elements.

Because all of each cam surface is exposed to the wiping action, while only the relatively small area of each engagement tab which bears on the associated cam surface is exposed to the wiping action, one would expect wear to be more severe on the engagement tabs of the spring than on the cam surfaces. However, this is not a problem in practice. The spring is preferably formed from the commercially available steel wire of the type known in the spring trade as "music wire." Because the engagement tabs project generally forwardly (generally radially with respect to the pivot axis of the hinge), the circumferential surface of the wire forms the wear surface of each engagement tab. This surface is extremely smooth and hard, and is therefore extremely wear-resistant.

Preferably, each of the hinge elements is formed from a single piece of metal strip stock by a progressive die forming process in which the peaks of each cam surface are upset from the surrounding portions of the strip. It is believed that this process results in appreciable selective work-hardening of the metal which forms the peaks, so that the wear-resistance of the cam surfaces will be greatest at the summits of the peaks. Since the force between the engagement tabs of the spring and the cam surface during operation will be greatest at such summits, such selective work-hardening will increase the service life of the cam surfaces. The metal used to form the hinge elements should be chosen to achieve a proper balance of formability, work-hardenability and cost. Various ferrous metals, such as cold-rolled steel, can be utilized, as can certain non-ferrous metals.

Figure 8:
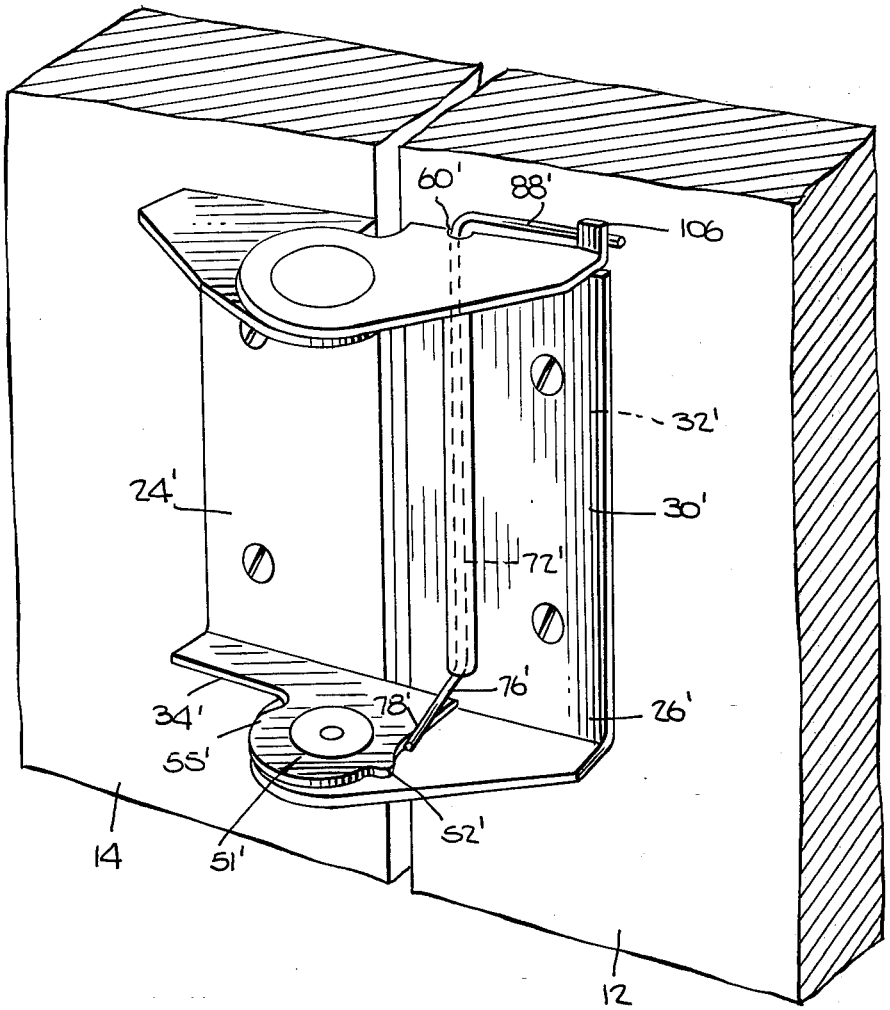
FIG. 8 is a perspective view depicting a hinge according to an alternate embodiment of the present invention.

An alternate embodiment of the present invention is shown in FIG. 8. The hinge according to this alternate embodiment is generally similar to the hinge of the preferred embodiment described above; the hinge depicted in FIG. 8 includes a first element 24' and a second element 26', which are pivotally connected to one another by an arrangement of bosses, holes and rivets similar to that described above. However, only one cam surface 51' is provided on the first element 24'. The peaks 52' and 55' of this cam surface project generally radially outwardly from the pivot axis 50'. Only one groove 60' is formed in the base wall 30' of the second element. This groove is open to the base surface 32' of the second element and it extends generally parallel to the pivot axis 50' of the hinge. The spring includes only one leg 72' and only one arm 76' which extends generally upwardly and axially from one end of the leg 72' to a free end 78'. The upwardly-bowed beam member 88' of the spring is affixed to the opposite end of the leg 72' and extends generally rearwardly from the leg. A prong 106 formed in the second element retains the end of the beam member remote from the leg against the surface of the door panel 12. The leg 72' of the spring is retained in the groove 60' by the surface of the door panel 12.

During pivoting motion of the hinge elements 24' and 26', the spring and cam surface of the hinge depicted in FIG. 8 will function in a manner analagous to the spring and cam surfaces of the preferred embodiment described above. As the free end 78' of the arm encounters the peaks 52' and 55' of the cam surface, the free end of the arm will be forced radially outwardly, away from the pivot axis of the hinge, in a pivoting motion about the axis of the leg 72'. This motion will cause the center of the beam member 88' to deflect downwardly, towards the door panel 12'. Of course, if it is desired to eliminate the detent function, the spring may be removed before the hinge is assembled to the door panels.

Numerous other alternate embodiments, each incorporating different variations and combinations of the features described above, can be utilized without departing from the spirit of the present invention as defined in the appended claims. Therefore, the foregoing detailed description of the preferred and alternate embodiments should be understood by way of exemplification, rather than limitation, of the present invention.

What is claimed is:

1. A hinge comprising a pair of elements, means for pivotally connecting said elements to one another at a common pivot axis, a first one of said elements having an undulate cam surface which extends about said pivot axis, the second one of said elements defining a generally planar base surface and an elongated groove open to said base surface, and a spring including a generally straight leg releasably received in said groove and an arm extending from a first end of said leg to a free end which is remote from the axis of said leg, said spring being constructed and arranged to bias said arm pivotally about the axis of said leg to urge the free end of said arm towards said cam surface, whereby the free end of said arm will engage said cam surface and said spring and said cam surface will cooperatively yieldably resist relative pivotal motion of said elements, said elements being adapted for attachment to respective ones of the structures which the hinge is to connect in service so that, during such attachment said base surface will overlie a surface of the one of such structures associated with said second element and that surface will retain said leg in said groove.

2. A hinge as claimed in claim 1 wherein said spring includes a beam member, a first end of said beam member is affixed to the end of said leg remote from said arm, said beam member extends generally perpendicularly from said leg, said beam member is substantially unsupported between its ends whereby said beam member serves as an active portion of said spring.

3. A hinge as claimed in claim 2 wherein said spring is constructed and arranged so that said beam member is bowed while the free end of said arm is engaged with a valley of said cam surface but said beam member is deformed to a substantially straight condition while the free end of said arm is engaged with a peak of such surface.

4. A hinge as claimed in claim 1 wherein said first element has a second undulate cam surface which extends about said pivot axis remote from the first-said cam surface, said second element defines a second elongated groove open to said base surface, said spring includes a second generally straight leg releasably received in said second groove, a second arm which extends from a first end of said second leg to a free end which is remote from the axis of said second leg and a beam member which extends from the second end of the first-said leg to the second end of said second leg, said spring is constructed and arranged to bias said second arm pivotally about the axis of said second leg to urge the free end of said second arm toward said second cam surface whereby the free end of said second arm will engage said second cam surface, and said spring and said elements are constructed and arranged so that the free end of said second arm will be aligned with a valley of said second cam surface whenever the free end of the first-said arm is aligned with a valley of the first-said cam surface and the free end of the second arm is aligned with a peak of the second cam surface whenever the free end of the first-said arm is aligned with a peak of the first-said cam surface.

5. A hinge as claimed in claim 4 wherein said grooves and said legs are substantially parallel to one another and extend generally transversely of said pivot axis, the peaks of the first-said cam surface extend generally axially in one direction, the peaks of the second cam surface extend generally axially in the opposite direction, and said beam member is substantially unsupported except at its junctures with said legs, whereby said beam member will serve as an active portion of said spring.

6. A hinge as claimed in claim 5 wherein said spring is constructed and arranged so that said beam member is bowed while the free ends of said arms are engaged with valleys of the associated cam surfaces but said beam member is deformed to a substantially straight condition while the free ends of said arms are engaged with peaks of the associated cam surfaces.

7. A hinge as claimed in claim 6 wherein said pivot axis is above the plane of said legs, said arms extend generally upwardly from said legs, said cam surfaces face toward one another so that the peaks of each such surface extend towards the other one of such surfaces and said beam member is bowed upwardly while said arms are engaged with the valleys of the associated cam surfaces.

8. A hinge as claimed in claim 7 wherein each one of said elements includes a base wall and a pair of generally parallel end walls which extend upwardly from such base wall at opposite ends thereof, the end walls of each such element extend forwardly of the base wall of that element, the forwardly projecting portion of each end wall of said first element partially overlaps an associated end wall of said second element, said means for pivotally connecting includes means for pivotally linking the overlapping portions of each such pair of associated end walls, each end wall of said first element defines one of said cam surfaces, and the base wall of said second element defines the base surface of said second element.

9. A hinge as claimed in claim 8 wherein each one of said elements includes at least one tab which extends downwardly from the forward edge of the base wall of such element, each such tab of the first element is aligned with an opposing tab of the second element, whereby such opposing tabs will abut one another when said elements are in a fully-flat position wherein the base walls of said elements are substantially coplanar, and said cam surfaces and said spring are constructed and arranged so that the free end of each one of said arms is engaged with a sloping surface of said cam surface when said elements are in said fully-flat position.

10. A hinge as claimed in claim 9 wherein at least one such tab of each of said elements is an attachment tab having a hole formed therein, the tab which opposes each such attachment tab is aligned with a portion of such attachment tab remote from the hole in such attachment tab, and the base wall of each one of said elements has at least one hole formed therein.

11. A hinge as claimed in claim 8 or claim 10, wherein each one of said elements is formed from a single piece of flat metal stock, upset portions of one such piece define the peaks of said cam surfaces, said spring is formed from a single piece of wire, and said spring is constructed and arranged so that the circumferential surface of said wire bears upon said cam surfaces.

12. A hinge comprising a first element and a second element, each such element having a base wall and a pair of generally parallel end walls which extend upwardly from such base wall at opposite ends thereof, the end walls of each such element extending forwardly of the base wall of that element, the forwardly-projecting portion of each end wall of said first element partially overlapping an associated end wall of said second element so that the end walls of said first element extend between the end walls of said second element, means for pivotally linking the overlapping portions of each such pair of associated end walls at a common pivot axis, the end walls of said first element defining a pair of opposing undulate cam surfaces, the underside of the base wall of said second element defining a base surface, said second element defining a pair of parallel elongated grooves which are open to said base surface and which extend generally forwardly from the rear edge of said base surface, the base wall of said second element having a hole extending therethrough at the forward end of each of said grooves, each one of said elements including at least one tab which extends downwardly from the forward edge of the base wall of such element, each such tab of the first element being aligned with an opposing tab of the second element, whereby such opposing tabs will abut one another when said elements are in a fully-flat position in which said base walls are substantially coplanar.

13. A hinge as claimed in claim 12 wherein at least one such tab of each of said elements is an attachment tab having a hole formed therein, the tab which opposes each such attachment tab is aligned with a portion of such attachment tab remote from the hole in such attachment tab, and the base wall of each one of said elements has at least one screw hole formed therein.

14. A hinge as claimed in claim 13 wherein each one of said elements is formed from a single piece of flat metal stock and upset portions of one such piece define the peaks of said cam surfaces.

15. A hinge comprising a first element, a second element and means for pivotally connecting said elements to one another at a common pivot axis, each one of said elements having a base wall and at least one tab which extends downwardly from the forward edge of such base wall, each such tab of said first element being aligned with an opposing tab of said second element, whereby such opposing tabs will abut one another when said elements are in a fully-flat position in which said base walls are substantially coplanar, at least one such tab of each of said elements being an attachment tab having a screw hole formed therein, the tab which opposes each such attachment tab being aligned with a portion of such attachment tab remote from the hole in such attachment tab, the base wall of each one of said elements having at least one screw hole formed therein, each one of said elements including a pair of generally parallel end walls which extend upwardly from opposite ends of its base wall, the end walls of each of said elements extending forwardly of the base wall of such element, the forwardly projecting portion of each end wall of said first element partially overlapping an associated end wall of said second element, said means for pivotally connecting including means for pivotally linking the overlapping portions of each pair of associated end walls, each one of said elements being from a single piece of flat metal stock.

* * * * *